United States Patent [19]

Winzelberg

[11] 4,103,882

[45] Aug. 1, 1978

[54] APPARATUS FOR USE IN FORMING A FINISH ON A JEWELRY BAND

[76] Inventor: Abraham Winzelberg, 3620 Bowne St., Flushing, N.Y. 11354

[21] Appl. No.: 837,852

[22] Filed: Sep. 29, 1977

[51] Int. Cl.[2] ..... B25B 5/14

[52] U.S. Cl. ..... 269/51

[58] Field of Search ..... 269/47, 50, 51, 48.1, 269/71, 75; 29/160.6

[56] References Cited

U.S. PATENT DOCUMENTS

| | | | |
|---|---|---|---|
| 1,603,070 | 10/1926 | Cox et al. | 269/50 |
| 2,470,487 | 6/1949 | Hollis | 269/48.1 |
| 3,860,228 | 1/1975 | Cronier | 269/75 |

*Primary Examiner*—Robert C. Watson

*Attorney, Agent, or Firm*—Amster, Rothstein & Engelberg

[57] ABSTRACT

An apparatus for use in forming a finish on a jewelry band has a base, a chassis rotatably mounted to the base and a mandrel rotatably mounted to the chassis. The mandrel is operable to engage the blank jewelry band on which the finish is to be formed. The apparatus further includes means allowing the chassis to be secured in position relative to the base and means allowing the mandrel to be secured relative to the chassis. The finish is produced by positioning a forming tool having a predetermined front cross section against the blank jewelry band and striking the forming tool, forming an indent in the band corresponding to the shape of the forming tool. The relative independence of the mandrel, chassis and base allows the band to be positioned at an ideal angle for striking.

2 Claims, 8 Drawing Figures

FIG. 1.
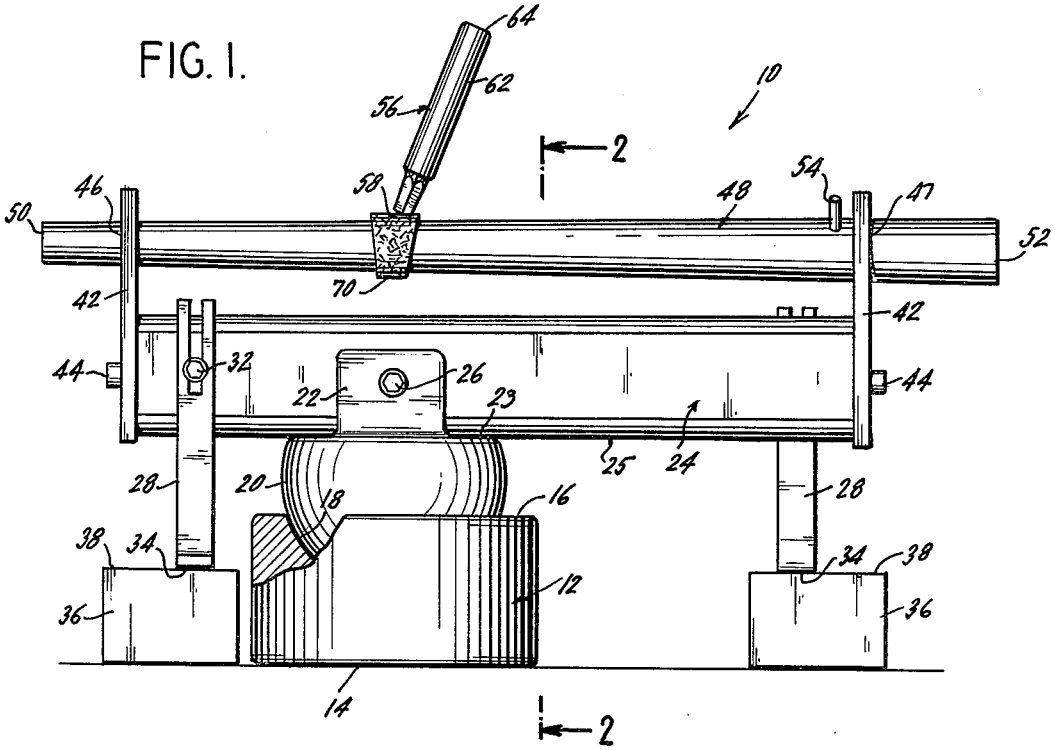
FIG. 2.
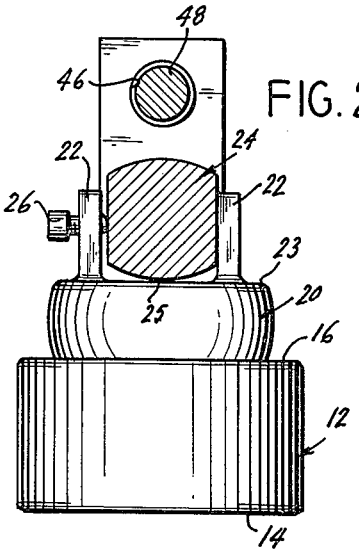
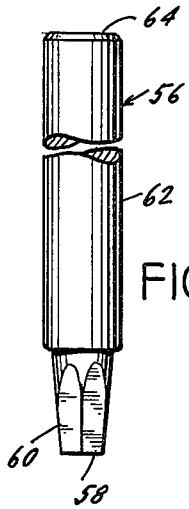
FIG. 3.
FIG. 4.
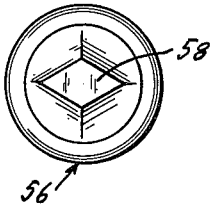
FIG. 5.
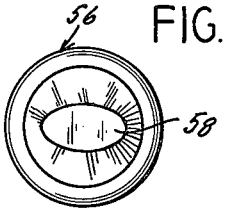
FIG. 8.
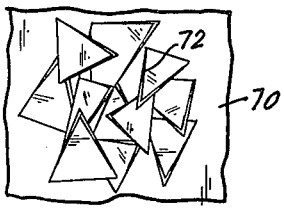
FIG. 6.
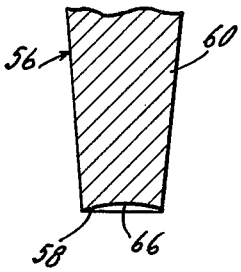
FIG. 7.
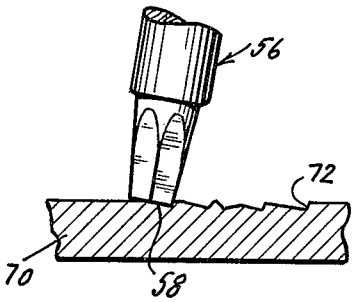

APPARATUS FOR USE IN FORMING A FINISH ON A JEWELRY BAND

The claimed invention relates to jewelry making, and in particular, to an apparatus for use in producing a finish on a blank jewelry band.

Bands employing a variety of surface finishes have become increasingly used as jewelry items. While in the past, jewelry bands have had a substantially smooth finish, it has become increasingly commonplace to form such bands with interesting and distinctive surface finishes. Such finishes often take the nature of a repeating and interwoven pattern of common geometric shapes, including ovals, diamonds, circles, triangles, squares, etc. Unfortunately, forming complex finishes on a jewelry band is often an expensive process requiring a large expenditure of time and a skilled operator. In addition, it is often difficult to produce uniform finishes.

Finishes of the type under discussion are normally produced by mounting a blank band on a stationary vise-type apparatus. A forming tool is positioned adjacent the band and is struck, deforming the surface of the band to correspond to the front cross-section of the forming tool. Those skilled in the art recognize the importance of being able to position the tool at a desired angle for striking; however, the stationary nature of the vise requires that the operator maneuver his forming tool in awkward positions and often strike the tool at a less than ideal angle.

Improved vises include adjustable settings but often these settings must be changed when a finished band is to be removed and replaced with a new blank. All of these disadvantages of prior apparatuses may result in the finished product being less than perfect, may require a skilled operator and a large expenditure of time, and may make it difficult to produce uniform bands.

It is therefore an object of the present invention to provide an apparatus for use in forming a finish on a jewelry band which allows the operator to maneuver the band so that the tool may always be positioned for striking at an ideal angle.

It is a further object of the present invention to provide an apparatus which allows the operator to change jewelry bands without altering the apparatus setting.

It is yet another object of this invention to provide an apparatus which allows the operator to rotate the band so that any segment of the band may be worked on without the need for altering the apparatus setting.

It is still another object of the invention to provide an apparatus for repeatedly and reliably forming a finish on a jewelry band which is inexpensive to construction and easy to use.

The aforementioned objects of the present invention are achieved by mounting a blank jewelry band on the mandrel of an apparatus, the mandrel being rotatable with respect to the chassis and the chassis being rotatable with respect to the apparatus base. This structure allows for any segment of the band to be made easily accessible to the forming tool, thus letting the operator strike the tool at a desired angle. In addition, the relative independence of mandrel, chassis and base permit the substitution of jewelry bands without altering the chassis setting.

In accordance with an illustrative embodiment of the present invention, there is provided an apparatus for use in producing a finish on a jewelry band which comprises a base including a socket, a chassis, a ball integrally mounted to the chassis and swivelly mounted to the base, and stabilizing arms adjustably mounted to the chassis. These stabilizing arms constitute locking means operable to secure the chassis in position relative to the base. The apparatus further includes a mandrel in the shape of a frustum of increasing cross-sectional area, which is encompassed by the blank jewelry band. The chassis includes two extending arms, each of which has an aperture, with the mandrel being suspended within the apertures. The apertures are dimensioned in accordance with the mandrel so that the mandrel may be slid relative to the arms from a first position in disengageable relation to the jewelry band, to a second position in rotatable relation to the arms, to a third locked position secured to the arms. A pin is removably mounted transverse to the longitudinal axis of the mandrel and is operable to limit the movement of the mandrel with respect to the arms when the mandrel moves from the third to the second position.

The finish is formed by moving the mandrel to the first position, with the pin removed, and mounting the band on the mandrel by forcing it along the mandrel in the direction of increasing mandrel cross-section until it is secured. The mandrel is next moved in the direction of its decreasing cross-section with respect to the arms to the second position and the pin is replaced. In this position the operator may rotate the mandrel to a desired position. The mandrel is next moved further in the direction of its decreasing cross-section with respect to the arms until it fits snuggly and is secured to the arms extending from the chassis. This is the third or locked position. The operator is now free to adjust the stabilizing arms and thus adjust the setting of the chassis with respect to the base without altering the position of the band with respect to the mandrel.

With the band at the desired position, the operator positions a forming tool of predetermined front cross-section against the band. The tool is then struck causing the metal under the band to deform into a shape corresponding to the front cross-section of the tool. This is repeated and the mandrel and chassis settings may be independently adjusted.

When one band is completed the operator removes the pin and moves the mandrel in the direction of increasing cross-section with respect to the arms to the first position. The band is urged in the direction of decreasing mandrel cross-section and the band may be disengaged from the mandrel and replaced with a blank band, all without altering the chassis settings. The new band can now be finished as described above.

The foregoing brief description, as well as further objects, features and advantages of the present invention, may best be appreciated by reference to the following detailed description of a presently preferred, but nonetheless illustrative embodiment in accordance with the present invention, wherein:

FIG. 1 is a front elevational view of an apparatus for use in producing a finish on a jewelry band made in accordance with the present invention;

FIG. 2 is a sectional view taken along the line 2—2 of FIG. 1;

FIG. 3 is a front elevational view of a forming tool for use in conjunction with the apparatus;

FIG. 4 is a bottom plan view of the forming tool of FIG. 3 having a front cross-section being substantially in the shape of a diamond;

FIG. 5 is a bottom plan view of the forming tool of FIG. 3 having a front cross-section substantially oval in shape;

FIG. 6 is a sectional view of a forming tool of the type shown in FIG. 3 having a recess formed in the front cross-section of the tool;

FIG. 7 is a view showing a jewelry band in section and showing a forming tool positioned against the band; and FIG. 8 is an illustrative segment of a finished band showing the surface finish as formed.

Referring now to the details of the drawing, an apparatus for use in forming a finish on a jewelry band is generally designated by the reference numeral 10. Apparatus 10 includes base 12 having lower surface 14 and upper surface 16. Upper surface 16 includes socket 18 into which is fitted ball 20. Ball 20 has flanges 22 extending upward from upper surface 23 of ball 20. Lower surface 25 of chassis 24 is mounted flush to upper surface 23 of ball 20. Chassis 24 is secured to ball 20 through flanges 22 by means of set screw 26 as shown in FIG. 1. Also mounted to chassis 24 are stabilizing arms 28. Stabilizing arms 28 each include a slot 30. Set screws 32 mounted to chassis 24, when loosened, allow stabilizing arms 28 to slide longitudinally with respect to set screws 32 and when tightened, set screws 32 secure stabilizing arms 28 in position. Communicating with lower surface 34 of stabilizing arms 28 are blocks 36 having upper surfaces 38.

Mounted at either end of chassis 24 by means of set screws 44 are arms 42. As can be seen by reference to FIG. 2, arms 42 include apertures 46, 47, the apertures 46, 47 being axially aligned. Suspended within apertures 46, 47 is mandrel 48. Mandrel 48 is generally circular in cross-section as can be seen by reference to FIG. 2, and is generally frustum-shaped, running from a smaller cross-section at end 50 to larger cross section at end 52. Throughout this description, moving mandrel 48 in the direction of its increasing cross section with respect to arms 42 refers to moving it from left to right, looking at FIG. 1. Apertures 46, 47 are of different cross-section area and are dimensioned in conjunction with mandrel 48 so that when mandrel 48 is urged from right to left (looking at FIG. 1), mandrel 48 is locked in position by the action of mandrel 48 against the inner surface of apertures 46, 47. This is referred to as the third or locked position. Pin 54 is removably mounted to mandrel 48 and is normally separate from arm 42. While mandrel 48 is urged from left to right (looking at FIG. 1), mandrel 48 is no longer secured to arms 42 and can be rotated along its longitudinal axis. This is referred to as the second position. In place, pin 54 provides a right terminus to the lateral movement of mandrel 48. When pin 54 is removed, mandrel 48 can be moved further rightward, disengaging end 50 from extending arm 42, thus allowing for jewelry band 70 to be removed by urging it from right to left with respect to mandrel 48 without changing the settings of chassis 24 with respect to base 12. This is referred to to as the first position.

Forming tool 56 includes front end 58. Extending from front end 58 is intermediate portion 60 which terminates in gripping handle 62. Gripping handle 62 terminates in rear end 64, which is generally flat and which is the surface which is struck by a hammer (not shown) in forming the finish. As can be seen by reference to FIG. 4 and FIG. 5, forming tool 56 may have front end 58 of several different shapes, for example, the diamond-shape as shown in FIG. 4, and the oval shape as shown in FIG. 5. In addition, to form yet another style of finish on the jewelry band, front end 58 may include recess 66, as shown in FIG. 6. When a forming tool 56 with such a recess 66 is used to form the finish, the metal from the band deforms and takes the position of recess 66.

As can be seen by reference to FIG. 7, forming tool 56 is positioned adjacent outer surface 68 of band 70. When forming tool 56 is struck by the hammer (not shown), indents 72 are formed. As can be seen by reference to FIG. 8, by the operator adjusting the position of the forming tool and striking the newly-positioned tool, a wide variety of surface shapes can be formed.

By rotating mandrel 48 with respect to extending arms 42, the operator can position jewelry band 70 so that any segment can be in the position most easy for him to strike. This lateral movement of mandrel 48 is accomplished without any change in the position of chassis 24 with respect to base 12.

The position of chassis 24 with respect to base 12 can be altered by use of set screws 32. By loosening set screws 32, chassis 24 can be adjusted about the axis running through ball 20 from front to back (looking at FIG. 1). By retightening set screws 32, the desired position about this axis can be maintained. Chassis 24 can also be rotated about the vertical axis of ball 20 by moving stabilizing arms 28 and block 36. Thus, by rotating either mandrel 48 with respect to chassis 24, or chassis 24 with respect to base 12, jewelry band 70 can be adjusted in all three planes with respect to base 12.

To produce the desired finish on the jewelry band, the operator removes pin 54 and slides mandrel 48 from left to right (looking at FIG. 1) to the first position. A jewelry band 70 is urged along mandrel 48 in the direction of its increasing cross-section, reaching a point where the corresponding diameter of the inner surface of band 70 abutting the outer surface of mandrel 48 causes band 70 to be retained in position with respect to mandrel 48. End 50 is then replaced through aperture 46 and pin 54 is replaced, creating the second position. The longitudinal rotation of mandrel 48 allows the operator to have access to all sections of band 70. Urging mandrel 48 further leftward (looking at FIG. 1) will cause mandrel 48 to reach a position in its relationship with apertures 46 and 47, so as to lock mandrel 48 in position with respect to arms 42 and thus chassis 24. This is the third position. The operator may then, as described above, adjust the position of chassis 24 with respect to base 12. The operator next places forming tool 56 in a position adjacent to the outer surface 58 of band 70, and strikes rear end 64 of forming tool 56, deforming the segment of metal under front end 58 of forming tool 56, thus forming indent 72. By maneuvering forming tool 56, by adjusting mandrel 48 and by adjusting chassis 24, the operator is able to produce the desired surface finish as shown in FIG. 8. The operator is then free to urge band 70 left to right along mandrel 48 in the direction of its decreasing cross-section, thus freeing the band front mandrel 48. By removing pin 54 and sliding mandrel 48 from left to right (looking at FIG. 1), end 50 is disengaged from aperture 46, and the finished jewelry band 70 may be removed and replaced with a blank band.

Although the invention has been described in terms of an embodiment for illustrative purposes, it will be appreciated by one skilled in the art that numerous additions, substitutions and modifications are possible without departing from the scope and spirit of the invention as defined in the accompanying claims.

What is claimed is:

1. Apparatus for use in forming a finish on a jewelry band comprising: a base; a chassis rotatably mounted to said base; first locking means for securing said chassis in position relative to said base; a mandrel, said mandrel being shaped in the form of a frustum of continuously increasing cross-sectional area, said mandrel further having a substantially circular cross section; and positioning means operable selectively to move said mandrel from a first position in disengageable relation to said jewelry band to a second position in rotatable relation to said chassis to a third position secured to said chassis, said positioning means including two arms extending from said chassis, each of said arms including an aperture, said mandrel being suspended within said apertures, said apertures being dimensioned in accordance with said mandrel so that when said mandrel is in said first and second positions, said mandrel is freely rotatable with respect to said arms, and when said mandrel is in said third position, said mandrel is secured in position with respect to said arms.

2. Apparatus in accordance with claim 1 wherein said positioning means further includes a pin removably mounted to said mandrel transverse to the longitudinal axis of said mandrel, said pin being operable to limit the movement of said mandrel with respect to said arms when said mandrel moves from said third to said second position.

* * * * *